United States Patent [19]

McClune

[11] Patent Number: 4,645,706

[45] Date of Patent: Feb. 24, 1987

[54] TREATED CLOTH AND METHOD OF PREPARING SAME

[76] Inventor: June A. McClune, 104 Oak Hill Way, No. A, Los Gatos, Calif. 95030

[21] Appl. No.: 834,809

[22] Filed: Feb. 28, 1986

[51] Int. Cl.[4] ..... B32B 3/00; B32B 9/02; B05D 3/02; B05D 5/04

[52] U.S. Cl. ..... 428/196; 427/260; 427/288; 427/389.9; 427/421; 428/291

[58] Field of Search ..... 428/291, 196; 427/417, 427/421, 260, 261, 389.9, 265, 288; 106/265

[56] References Cited

U.S. PATENT DOCUMENTS

| | | | |
|---|---|---|---|
| 625,030 | 5/1899 | Harwood | 106/265 X |
| 1,297,009 | 3/1919 | Prifold | 427/261 X |
| 1,725,794 | 8/1929 | Harvey | 428/291 X |
| 1,761,715 | 6/1930 | Fleetwood | 427/260 |
| 3,160,511 | 12/1964 | Skeen et al. | 427/389.9 |

*Primary Examiner*—Evan K. Lawrence

*Attorney, Agent, or Firm*—Fliesler, Dubb, Meyer & Lovejoy

[57] ABSTRACT

The invention provides a method of treating a cloth to prevent lateral bleeding into the cloth of a later applied oil-based paint and the resulting treated cloth. That portion of the surface of the cloth which is to be painted with an oil-based paint is first sprayed with small droplets of a composition of matter which consists essentially of a hydrocarbon solvent having a boiling point range from above about 25° C. to below about 100° C. and a triglyceride ester having 30 to 70 carbons atoms. The amount of the composition of matter is such as to provide from about a 1 gram per square meter coating of the triglyceride ester to about a 3.5 grams per square meter coating of the triglyceride ester on the surface portion. The sprayed surface portion is then dried to vaporize the solvent prior to application of the oil-based paint thereto. Operation in accordance with the present invention allows oil-based paints to be used to produce works of art on materials upon which such works of art could not previously be adequately prepared.

12 Claims, No Drawings

TREATED CLOTH AND METHOD OF PREPARING SAME

TECHNICAL FIELD

The invention relate to a method of treating a cloth to prevent bleeding of a later applied oil-based paint thereinto and to the resulting cloth. Cloths treated in accordance with the present invention will accept oil-based paint and the oil-based paint will not bleed into them.

BACKGROUND ART

Oil-based paint is a particularly desirable medium for the preparation of works of art. Such paints have been successfully applied to various types of board and to stretched canvas but have not been successfully applied to common cloths such as cotton, silk, linen, rayon, or the like. The reason for this is that if the oil-based paint is applied to such a cloth both the oil and the color suspended therein will tend to bleed laterally into the cloth about the area painted.

It is known to pretreat board and canvas prior to their use by using sealing materials including washes of oil-based paint diluted with paint thinner and the like. Such methods are not applicable to cloths which, if treated in such a manner, would be far too heavily coated and would assume an undesirable oily appearance and/or would become stiff.

DISCLOSURE OF INVENTION

The present invention is directed to solving one or more of the problems as set forth above.

In accordance with the present invention a method is set forth of treating a cloth to prevent lateral bleeding thereinto of a later applied oil-based paint. The method comprises spraying at least a portion of the surface of the cloth which is to be painted with small droplets of a composition of matter which consists essentially of a hydrocarbon solvent having a boiling point range from above about 25° C. to below about 100° C. and a triglyceride ester having 30 to 70 carbon atoms. The amount of the composition of matter which is used is such as to provide from about a 0.5 gram per square meter coating of ester to about a 3.5 grams per square meter coating of ester on the portion of the surface which is sprayed. The sprayed surface portion is then dried until the hydrocarbon solvent has substantially vaporized prior to application of the oil-based paint thereto. The invention also relates to the thus prepared and treated cloth.

When a flexible cloth is treated with a composition of matter as set forth above, in the manner set forth above, and in the concentration range set forth above, the resulting cloth will accept oil-based paints and the oil-based paints will not bleed into the cloth. Also, the cloth will not stiffen or exhibit an undesirable oily appearance. As a result, artists can paint on common flexible cloth materials, for example on clothing or the like, and can produce a work of art which does not suffer from the problem of bleeding.

BEST MODE FOR CARRYING OUT INVENTION

In accordance with the present invention it has been discovered that if a cloth, for example one made of cotton, silk, linen, rayon, nylon, dacron, satin, or the like, is properly treated, oil-based paints can be applied thereto without the oil-based paints bleeding away from the area of their application. To accomplish this it is necessary that a very specific composition of matter be utilized, which composition of matter consists essentially of two components, and with the composition of matter being used in a specific amount dependent upon the surface area being treated thereby.

The composition of matter of the present invention consist essentially of a hydrocarbon solvent having a boiling point range from above about 25° C. to below about 100° C. This assures that the hydrocarbon solvent is volatile enough so that it can volitalize from the cloth in a reasonable period of time. Generally, the hydrocarbon solvent will be in the nature of a petroleum distillate and is preferably ordinary paint thinner. The specific chemical structures of the components of the hydrocarbon solvent are not critical so long as the solvent has the boiling point range just discussed.

The second component of the composition of matter is a triglyceride ester having 30 to 70 carbon atoms. Normally, such triglyceride ester will be any of the conventional naturally occurring triglyceride esters such as linseed oil, corn oil, soybean oil, cottonseed oil, flaxseed oil, coconut oil, peanut oil, olive oil, or the like. Such triglyceride esters are generally esters formed between glycerol and three saturated or unsaturated organic acids, each generally having from about 8 to about 25 carbons, usually arranged in a linear chain. The preferred triglyceride ester for use in the present invention is linseed oil since linseed oil is utilized in oil-based paints and a high degree of compatibility can be assured by utilizing linseed oil as the triglyceride ester. It should be noted that each of the triglyceride esters set forth above is often present in impure form when obtained from nature and generally retains at least some impurities after processing. For example, such linseed oil as is normally used in oil-based paints, and as is useful in the present invention, generally contains several percent of naturally occurring impurities therewith.

While the composition of the matter of the present invention consists essentially of the two listed ingredients, it should be recognized that it may also include a number of other ingredients which do not effect its usefulness to any significant extent. For example, the composition of matter may also include some pigment. This can occur if the composition is made by diluting a linseed oil-based paint with a hydrocarbon solvent so as to provide the required composition.

The volumetric ratio of hydrocarbon solvent to triglyceride ester preferably falls within a range from about 5:1 to about 5:3. More preferably, the ratio is about 2:1. If too much triglyceride ester is present the cloth may exhibit an oil stain. If too little triglyceride ester is present it will take an overly long period of time for the hydrocarbon solvent to vaporize and it will be necessary to utilize relatively large amounts of hydrocarbon solvent in a wasteful manner and with added problems of flammability.

In accordance with the method of the present invention a cloth is treated to prevent lateral bleeding thereinto of a later applied oil-based paint. First, at least that portion of the surface of the cloth which is to be painted is sprayed with small droplets of the composition of matter discussed above. It is essential that the amount of the composition of matter be such as to provide from about a 0.5 gram per square meter coating of ester to about a 3.5 grams per square meter coating of ester on the surface portion. Preferably, the amount of ester will be from about 1 gram per square meter to about 3 grams per square meter. Particularly good results are achieved with a wide variety of cloth materials when the amount of ester is from about 2 grams per square meter to about 2.5 grams per square meter. The sprayed surface portion is then dried to allow the hydrocarbon solvent to evaporate. Generally this will take about 1 hour at ambient conditions and can be significantly speeded up using a fan, particularly a heater-fan combination such as a hair dryer of a forced air furnace register. The resulting cloth includes the triglyceride oil which is left behind on the surface portion after the hydrocarbon solvent has vaporized and which is evenly distributed as a fine coating through action of the hydrocarbon solvent aiding wetting of the cloth.

The spraying may take place by wetting a brush with the composition of matter discussed above, removing any loose droplets from the brush as by running the brush across the top of the container of the composition of matter, and then brushing the brush along the top surface of a screen held just above the portion of the surface of the cloth which is to be painted. Alternatively, the composition of matter may be sprayed utilizing a hand pump bottle or a pressurized spray bottle having an appropriate propellant such as propane.

The amount of triglyceride ester deposited, per square meter of the portion of the surface of the cloth that is coated, is critical and has been determined by testing a number of different cloths, specifically silk, cotton, crepe, satin, dacron and nylon cloths. The resulting cloth, once the hydrocarbon solvent has evaporated, must generally have from about a 0.5 gram per square meter coating of ester to about a 3.5 grams per square meter coating of ester, more preferably from about a 1 gram per square meter coating of ester to about a 3 grams per square meter coating of ester, and still more prefereably from about a 2 grams per square meter coating to about a 2.5 grams per square meter coating of ester on the surface portion which is sprayed with the composition of matter.

INDUSTRIAL APPLICABILITY

A cloth treated in accordance with the present invention and utilizing the composition of matter of the present invention may be painted with an oil-based paint and the paint will not bleed from the spot where painted on to other portions of the treated portion of the surface of the cloth. The cloth is non-oily in appearance and retains its flexibility. Furthermore, the cloth can be laundered after it has been painted and will retain the oil-based paint.

Other aspects, objectives and advantages of this invention will be apparent from study of the disclosure and the appended claims.

I claim:

1. A method of treating a cloth to prevent lateral bleeding thereinto of a later applied oil-based paint, comprising:

spraying at least that portion of the surface of the cloth which is to be painted with small droplets of a composition of matter consisting essentially of a hydrocarbon solvent having a boiling point range from above about 25° C. to below about 100° C. and a triglyceride ester having 30 to 70 carbon atoms, the amount of the composition of matter being such as to provide from about a 0.5 gram per square meter coating of the triglyceride ester to about a 3.5 grams per square meter coating of the triglyceride ester on said surface portion; and drying the sprayed surface portion for a sufficient time for the hydrocarbon solvent to vaporize prior to application of said oil-based paint thereto.

2. A method as set forth in claim 1, wherein said spraying comprises wetting a brush with said composition of matter, removing any large droplets from said brush, and brushing said brush across a screen held just above said portion of the surface of said cloth.

3. A method as set forth in claim 1, wherein said solvent is a petroleum distillate.

4. A method as set forth in claim 3, wherein said ester is linseed oil.

5. A method as set forth in claim 4, wherein said petroleum distillate is paint thinner.

6. A method as set forth in claim 1, wherein the volumetric ratio of said solvent to said ester falls within a range from about 5:1 to about 5:3.

7. A method as set forth in claim 6, wherein said volumetric ratio is about 2:1.

8. A method as set forth in claim 3, wherein said petroleum distillate is paint thinner.

9. A method as set forth in claim 1, wherein the amount of the triglyceride ester falls within a range from about 1 gram per square meter to about 3 grams per square meter.

10. A method as set forth in claim 9, wherein the volumetric ratio of said solvent to said ester falls within a range from about 5:1 to about 5:3.

11. A method as set forth in claim 10 wherein tha amount of the triglyceride ester falls within a range from about 2 grams per square meter to about 2.5 grams per square meter.

12. A cloth treated to prevent bleeding of an oil-based paint applied thereto, said cloth being prepared in accordance with the method of claim 7.

* * * * *